US010441961B2

(12) United States Patent
Kikuchi et al.

(10) Patent No.: US 10,441,961 B2
(45) Date of Patent: Oct. 15, 2019

(54) ELECTROSTATIC COATING DEVICE

(71) Applicant: HONDA MOTOR CO., LTD., Tokyo (JP)

(72) Inventors: Takashi Kikuchi, Tochigi (JP); Norihiko Sudo, Tochigi (JP); Masaaki Shoji, Tochigi (JP); Toshiyuki Kokubo, Tochigi (JP); Koji Ikeda, Tochigi (JP); Hiroaki Takahashi, Tochigi (JP)

(73) Assignee: HONDA MOTOR CO., LTD., Tokyo (JP)

( * ) Notice: Subject to any disclaimer, the term of this patent is extended or adjusted under 35 U.S.C. 154(b) by 47 days.

(21) Appl. No.: 15/128,133

(22) PCT Filed: Mar. 24, 2015

(86) PCT No.: PCT/JP2015/058895
§ 371 (c)(1),
(2) Date: Sep. 22, 2016

(87) PCT Pub. No.: WO2015/146970
PCT Pub. Date: Oct. 1, 2015

(65) Prior Publication Data

US 2017/0106382 A1 Apr. 20, 2017

(30) Foreign Application Priority Data

Mar. 25, 2014 (JP) ..... 2014-062280

(51) Int. Cl.
*B05B 5/025* (2006.01)
*B05B 5/04* (2006.01)
(Continued)

(52) U.S. Cl.
CPC ..... *B05B 5/025* (2013.01); *B05B 5/04* (2013.01); *B05B 5/1616* (2013.01); *B05B 15/14* (2018.02)

(58) Field of Classification Search
CPC ..... B05B 5/025; B05B 5/04; B05B 5/1616; B05B 15/14
(Continued)

(56) References Cited

U.S. PATENT DOCUMENTS 3,061,198 A * 10/1962 Kerr ..... B01J 4/008 118/626
3,870,233 A * 3/1975 Wilhelm ..... B05B 5/16 239/692
(Continued)

FOREIGN PATENT DOCUMENTS

| | | |
|---|---|---|
| JP | 08-187452 | 7/1996 |
| JP | 10-216592 | 8/1998 |
| JP | 2009-72705 | 4/2009 |

OTHER PUBLICATIONS

International Search Report, dated Jun. 16, 2015 (Jun. 16, 2015).

*Primary Examiner* — Arthur O. Hall
*Assistant Examiner* — Steven M Cernoch
(74) *Attorney, Agent, or Firm* — Rankin, Hill & Clark LLP

(57) ABSTRACT

An electrostatic coating device that can suppress the arising of corrosion in insulating members and the like surrounding coating material supply and discharge paths because of leakage arising between the paths. An electrostatic coating device is characterized by being provided with: a body part; a head part; a linking part that links the body part and the head part; a coating material path that is a first path disposed from the body part to the head part, wherein a high-voltage is applied along with the coating material (first fluid) being fed; a washing fluid path that is a second path disposed from the body part to the head part, wherein a washing fluid (second fluid) is fed along with a connection to a ground;
(Continued)

and a displacement part for displacing all or part of air retained between the coating material path and a washing fluid path with new air.

1 Claim, 9 Drawing Sheets

(51) Int. Cl.
*B05B 5/16* (2006.01)
*B05B 15/14* (2018.01)

(58) Field of Classification Search
USPC ..... 239/690–708, 124–127, 128–139
See application file for complete search history.

(56) References Cited

U.S. PATENT DOCUMENTS 3,901,184 A * 8/1975 Payne ..... B05B 5/032 118/308
4,770,344 A * 9/1988 Kaiser ..... B05B 7/144 239/124
4,997,130 A * 3/1991 Weinstein ..... B05B 3/1064 239/222
5,040,732 A * 8/1991 Anderson ..... B05B 7/1218 239/124
5,106,024 A * 4/1992 Frene ..... B05B 12/14 239/112
5,353,995 A * 10/1994 Chabert ..... B05B 3/1064 239/701
5,632,448 A * 5/1997 Alexander ..... B05B 3/1064 239/703
5,697,559 A * 12/1997 Davis ..... B05B 3/1064 239/224
5,704,977 A * 1/1998 Baumann ..... B05B 3/10 118/320
5,853,126 A 12/1998 Alexander
6,021,965 A * 2/2000 Hartle ..... B05B 5/1608 138/120
6,164,561 A * 12/2000 Yoshida ..... B05B 3/10 222/148
6,612,345 B1 * 9/2003 Hosoda ..... B05B 3/1064 141/100
6,742,722 B2 * 6/2004 Hosoda ..... B05B 3/1064 239/305
7,128,277 B2 * 10/2006 Schaupp ..... B05B 5/04 239/3
7,703,700 B2 * 4/2010 Yasuda ..... B05B 3/1064 239/128
8,434,702 B2 * 5/2013 Mori ..... B05B 5/053 239/690
8,590,817 B2 * 11/2013 Baltz ..... B05B 5/0532 239/526
2009/0078801 A1 3/2009 Takahashi et al.

* cited by examiner

ELECTROSTATIC COATING DEVICE

TECHNICAL FIELD

The present invention relates to an electrostatic coating device.

BACKGROUND ART

Conventionally, a rotary atomizing-type electrostatic coating device has been known as a coating device for coating the body, etc. of automobiles. The rotary atomizing-type electrostatic coating device supplies conductive coating material (liquid coating material) to a rotary atomizing head, while applying high voltage and rotating this rotary atomizing head. The rotary atomizing-type electrostatic coating device thereby atomizes and sprays electrified liquid coating material to coat the target object.

As a rotary atomizing-type electrostatic coating device, for example, one is disclosed having a body part and a head part that is detachably mounted to the body part (for example, refer to Patent Document 1). In this electrostatic coating device, for example, the head part is removed from the body part when damaged or during part replacement. In addition, at coupling parts (end faces) of the body part and head part, the coating material supply/discharge paths and cleaning liquid paths are connected by a coupler or the like.

Herein, high voltage is applied to the coating material supply/discharge paths during electrostatic coating. For this reason, the coating material supply/discharge paths are arranged in a state enclosed by an insulating member (for example, resin), in order to protect from influences on other members, etc. For example, the coating material supply/discharge paths are arranged to be accommodated in a housing made of resin having holes formed in the shape of these coating material supply/discharge paths.

Patent Document 1: Japanese Unexamined Patent Application, Publication No. 2009-72705

DISCLOSURE OF THE INVENTION

Problems to be Solved by the Invention

However, in the electrostatic coating device of Patent Document 1, although high voltage is applied to the coating material supply/discharge paths in order to perform electrostatic coating, at this time, ground leakage may occur towards another path arranged in the vicinity of the coating material supply/discharge paths, particularly a path connected to earth.

Herein, in the case of ground leakage occurring at the coupling parts of the body part and head part, corrosion may occur at the insulating member, etc. around the coating material supply/discharge path, due to oxygen and nitrogen in the air stagnating around the coupling part reacting to change to ozone and nitrogen oxides.

Then, in this case, coating material leakage, a decline in insulating property when high voltage is applied, etc. may occur at the coupling part.

The present invention has been made taking account of the above, and the object thereof is to provide an electrostatic coating device capable for suppressing corrosion from occurring at the insulating member, etc. around the coating material supply/discharge paths due to ground leakage occurring between paths.

Means for Solving the Problems

In order to achieve the above-mentioned object, the present invention relates to an electrostatic coating device (e.g., the electrostatic coating device 1 described later) including: a body part (e.g., the body part 10 described later); a head part (e.g., the head part 20 described later); a coupling part (e.g., the coupling part 60 described later) that couples the body part and the head part; a first path (e.g., the coating material path 300*b* described later) disposed to span the body part and the head part, through which a first fluid (e.g., the coating material described later) is fed, and to which high voltage is applied; a second path (e.g., the washing fluid path 300*c* described later) disposed to span the body part and the head part, through which a second fluid (e.g., the washing fluid described later) is fed, and is grounded to earth; and a substitution part (e.g., the substitution part 200 described later) that substitutes the entirety or part of air stagnating between the first path and the second path with new air.

The electrostatic coating device of the present invention includes the substitution part that substitutes the entirety or part of the air stagnating between the first part and the second path with new air. Since it is thereby possible to replace with new air and discharge ozone and nitrogen oxides generated due to ground leakage occurring between paths, corrosion can be suppressed from occurring at the insulating member, etc. at the periphery of the coating material supply/discharge paths.

In this case, it is preferable for the first path to include: a body-side first path (e.g., the body-side coating material path 310*b* described later) disposed at a side of the body part; a head-side first path (e.g., the head-side coating material path 320*b* described later) disposed at a side of the head part; and a first connecting part (e.g., the connecting part 450*b* described later) disposed at the coupling part, and connecting the body-side first path and the head-side first path; and for the second path to include: a body-side second path (e.g., the body-side washing fluid path 310*c* described later) disposed at a side of the body part; a head-side second path (e.g., the head-side washing fluid path 320*c* described later) disposed at a side of the head part; and a second connecting part (e.g., the connecting part 450*c* described later) disposed at the coupling part, and connecting the body-side second path and the head-side second path; in which the coupling part has a surface-butting part (e.g., the surface-butting part 62 described later) configured by a first end face (e.g., the first end face 64 described later) that is an end face of the body part and a second end face (e.g., the second end face 66 described later) that is an end face of the head part abutting each other, and in which the substitution part (e.g., the substitution part 200 described later) substitutes the entirety or part of air stagnating between the first connecting part and the second connecting part at the surface-butting part with new air.

In the present invention, the substitution part substitutes the entirety or part of the air stagnating between the first connecting part and the second connecting part at the surface-butting part with new air. Since it is thereby possible to replace with new air and discharge ozone and nitrogen oxides generated due to ground leakage occurring at the surface-butting part, corrosion at the insulating member, etc. at the periphery of the coating material supply/discharge paths can be suppressed from occurring.

In this case, it is preferable for the substitution part to include: a blowing port (e.g., the blowing port 230 described later) that is formed in the first end face or the second end face, and blows air into the surface-butting part; and an exhaust port (e.g., the exhaust port 240 described later) that is formed in the first end face or the second end face, and through which air stagnating at the surface-butting part is discharged.

In the present invention, the substitution part includes the blowing port formed in the first end face of the second end face and blowing in air to the surface-butting part, and the discharge port formed in the first end face or the second end face and through which air stagnating at the surface-butting part is discharged. Since it is thereby possible to more reliably replace with new air and discharge ozone and nitrogen oxides generated due to ground leakage occurring at the surface-butting part, corrosion at the insulating member, etc. at the periphery of the coating material supply/discharge paths can be more reliably suppressed from occurring.

In this case, it is preferably for the substitution part to have a substituted space (e.g., the substituted space 235 described later) that is formed in at least one among the first end face and the second end face so as to link the blowing port and the exhaust port, and is configured so that air stagnated inside thereof is discharged from the exhaust port by air blown in from the blowing port.

In the present invention, the substitution part has the substituted space that is formed in at least one among the first end face and the second end face so as to link the blowing port and the exhaust port, and is configured so that air stagnated inside thereof is discharged from the exhaust port by air blown in from the blowing port. Since it is thereby possible to more reliably replace with new air and discharge ozone and nitrogen oxides generated due to ground leakage occurring at the surface-butting part, corrosion at the insulating member, etc. at the periphery of the coating material supply/discharge paths can be more reliably suppressed from occurring.

In this case, it is preferable for the substituted space to be formed so that at least a part thereof is disposed between the first connecting part and the second connecting part.

In the present invention, the substituted space is formed so that at least a part thereof is disposed between the first connecting part and the second connecting part. Since it is thereby possible to more reliably replace with new air and discharge this ozone and nitrogen oxides at the locations at which corrosion, etc. occurring due to the oxygen and nitrogen at the surface-butting part converting to ozone and nitrogen oxides tends to occur, corrosion at the insulating member, etc. at the periphery of the coating material supply/discharge paths can be more reliably suppressed from occurring.

In this case, it is preferable for the substituted space to be formed so as to surround the first connecting part or the second connecting part.

In the present invention, the substituted part is formed so as to surround the first connecting part or the second connecting part. Since it is thereby possible to more reliably replace with new air and discharge this ozone and nitrogen oxides at the locations at which corrosion, etc. occurring due to the oxygen and nitrogen at the surface-butting part converting to ozone and nitrogen oxides tends to occur, corrosion at the insulating member, etc. at the periphery of the coating material supply/discharge paths can be more reliably suppressed from occurring.

In this case, it is preferable for the electrostatic coating device to further include a conductive part (e.g., the conductive part 800 described later) that is at least partially disposed inside of the body part, and electrically links the first path and the second path.

In the present invention, the electrostatic coating device has a conductive part that is at least partially disposed inside of the body part, and electrically links the first path and the second path. Since it is thereby possible to decrease the ground leakage itself at the surface-butting part, corrosion can be suppressed from occurring at the insulating member, etc. at the periphery of the coating material supply/discharge paths due to ground leakage occurring between paths at the surface-butting part, etc.

Effects of the Invention

According to the present invention, it is possible to provide an electrostatic coating device capable for suppressing corrosion from occurring at the insulating member, etc. around the coating material supply/discharge paths due to ground leakage occurring between paths.

PREFERRED MODE FOR CARRYING OUT THE INVENTION

Hereinafter, the electrostatic coating devices of each embodiment will be explained while referencing the drawings.

Figure 1:
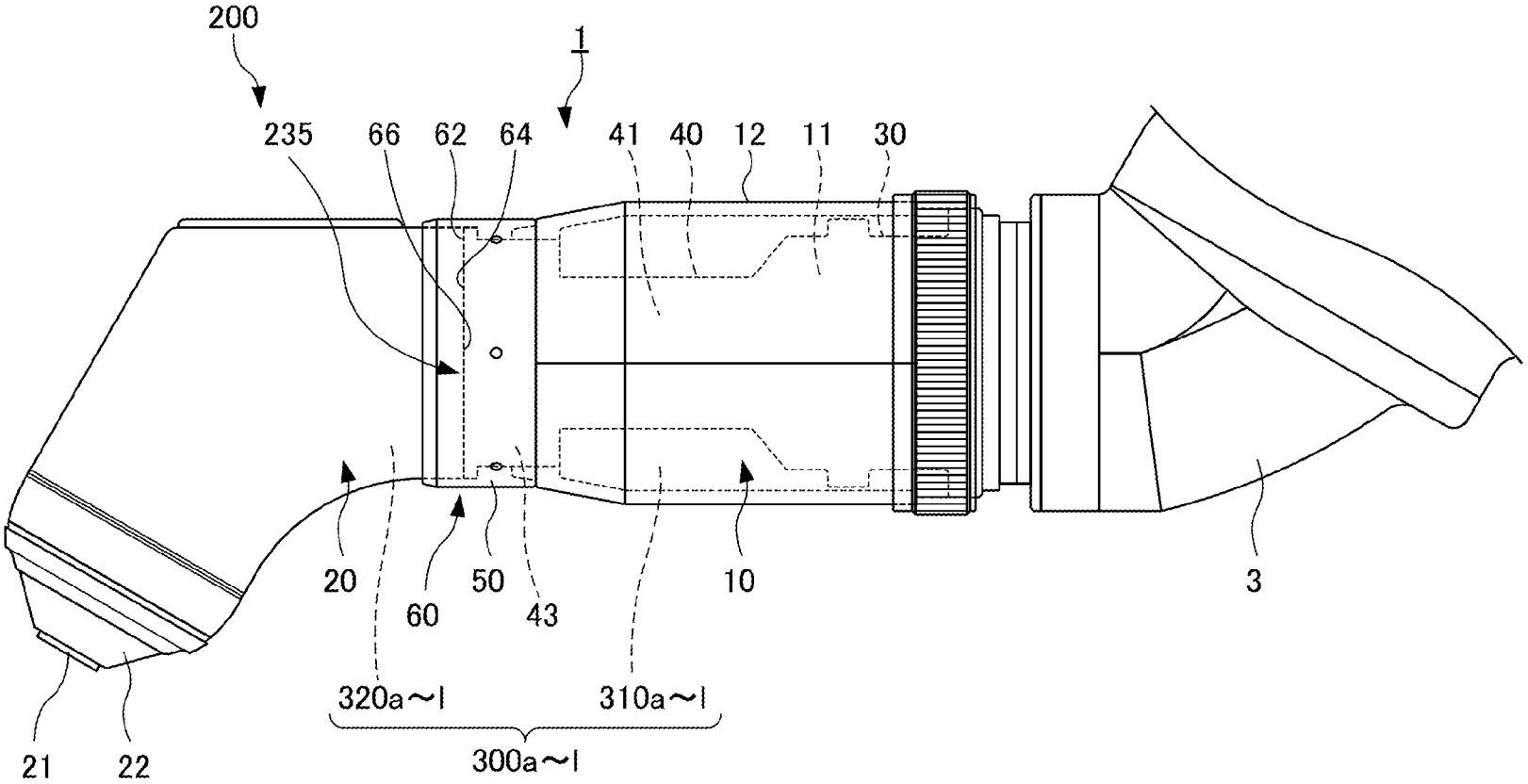
FIG. 1 is a side view of an electrostatic coating device of a first embodiment of the present invention.
Figure 2:
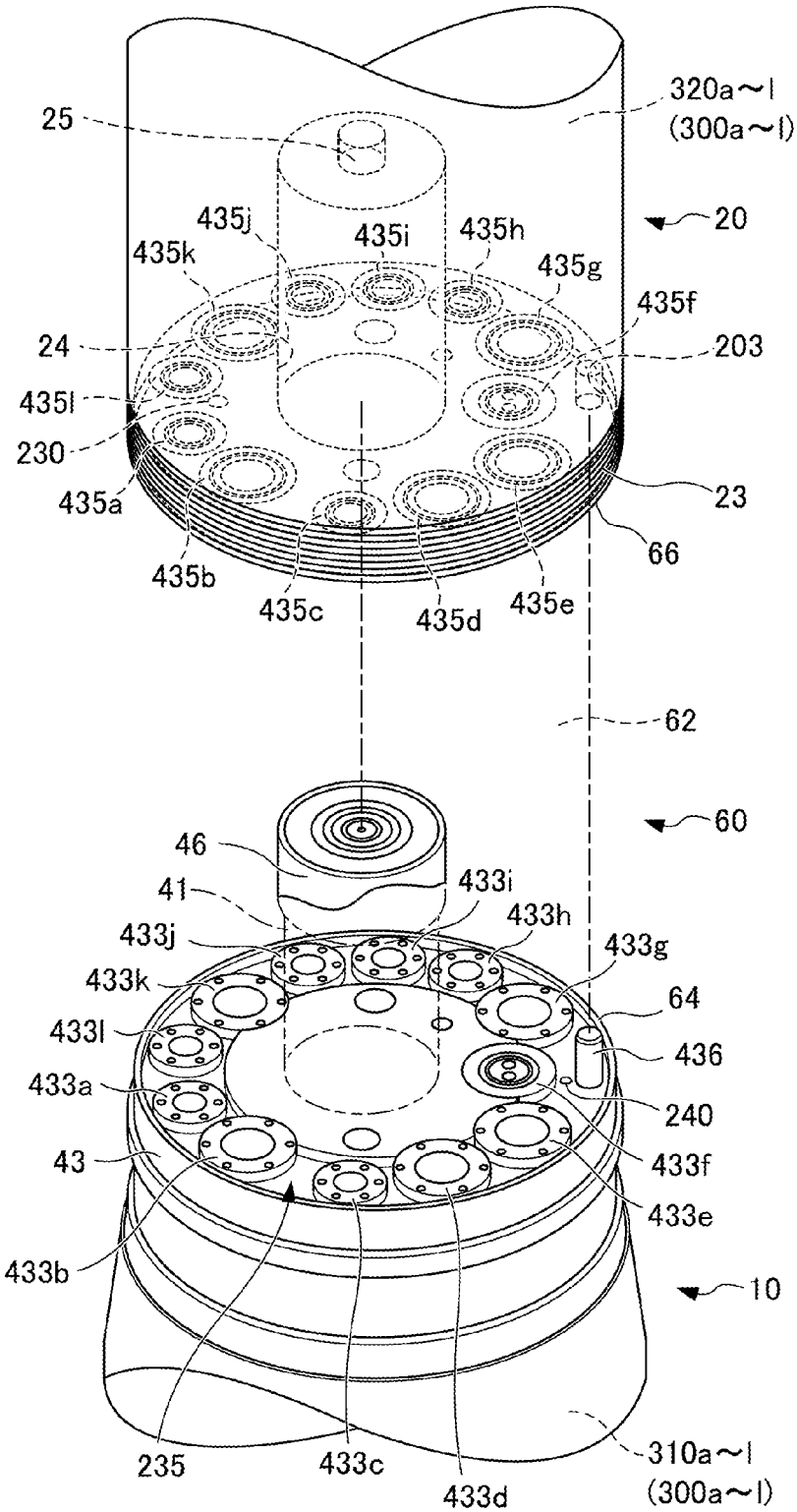
FIG. 2 is a view showing surface-butting parts of coupling parts of the first embodiment.
Figure 3:
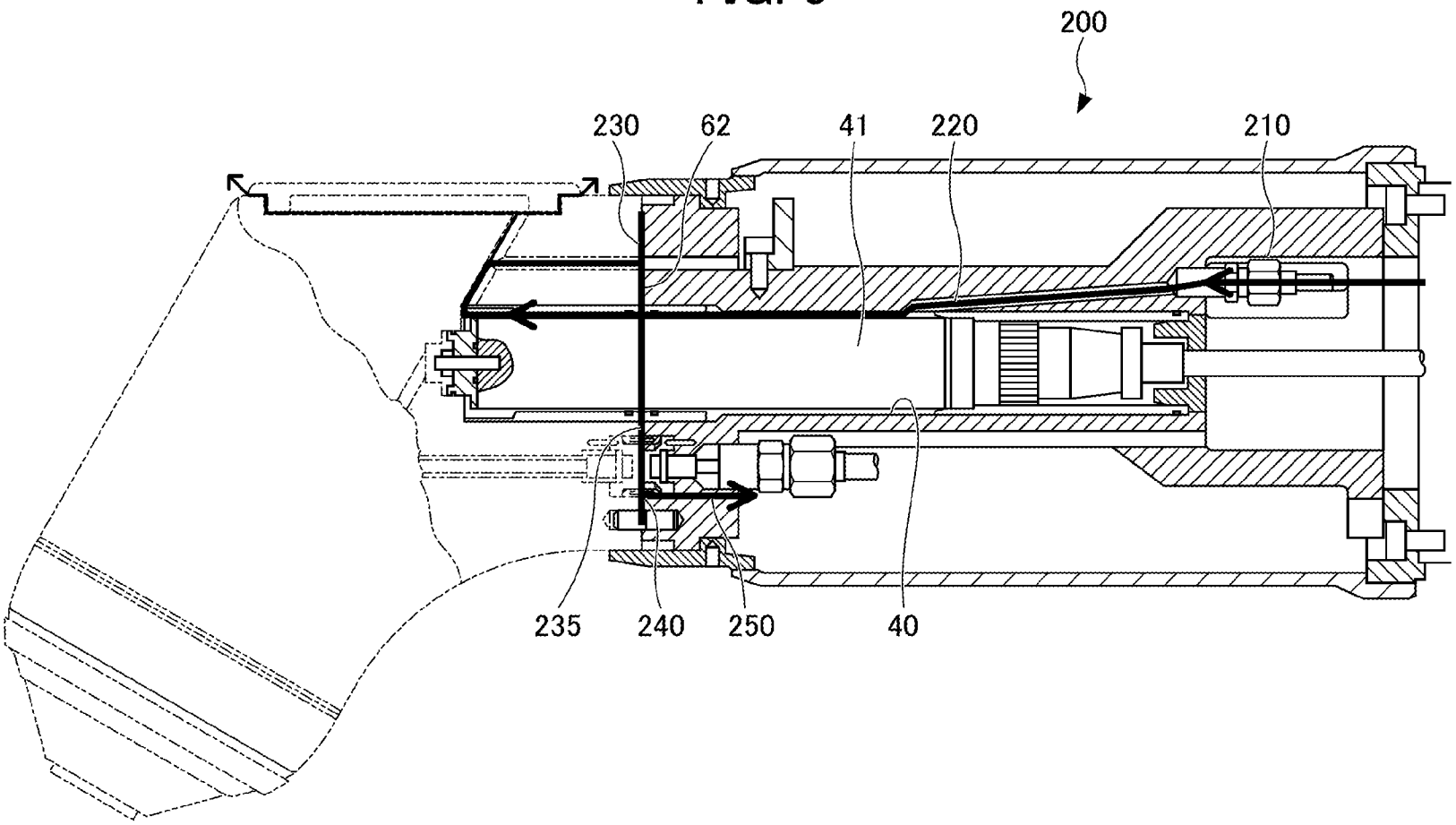
FIG. 3 is a view illustrating the overall configuration of a substitution part of the first embodiment.
Figure 4:
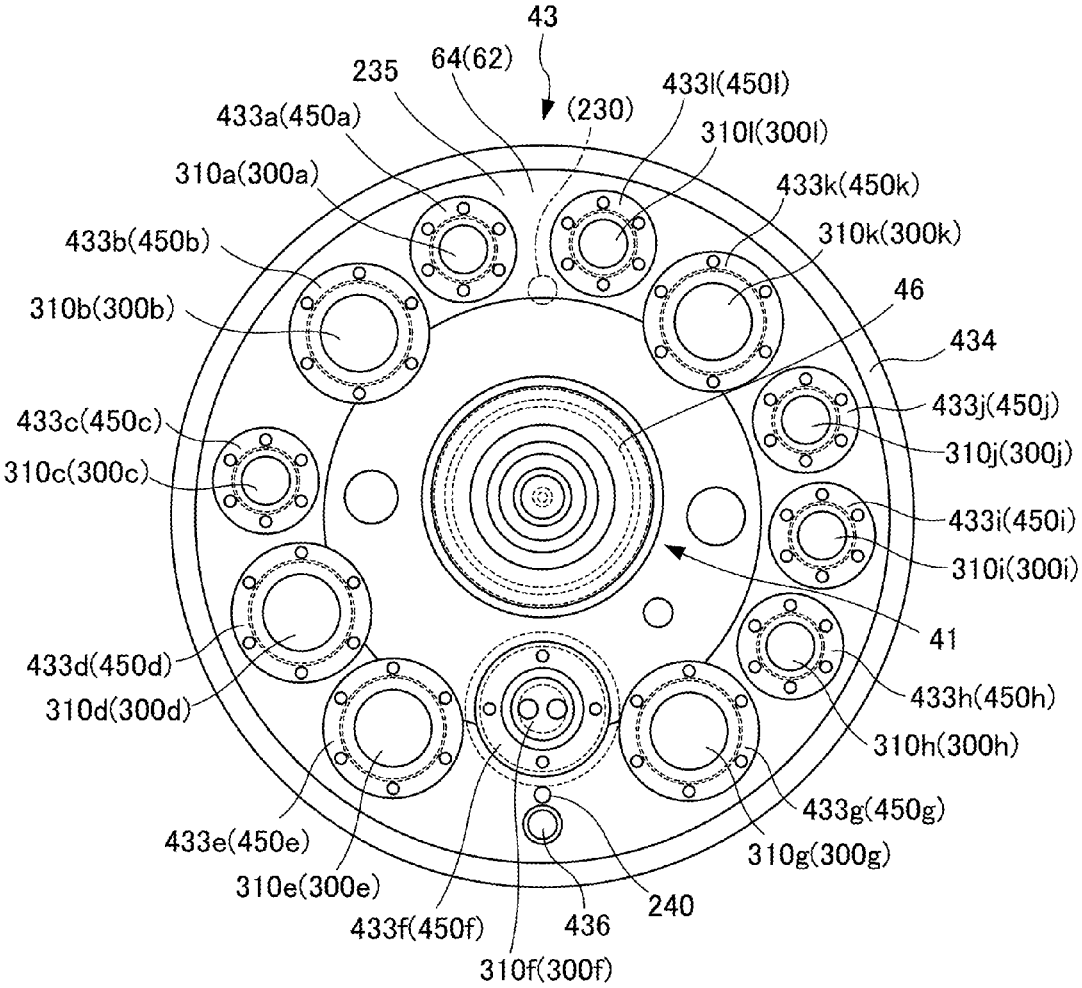
FIG. 4 is a view illustrating a blowing port, exhaust port and substituted space constituting the substitution part of the first embodiment.

First, the configuration of an electrostatic coating device 1 of a first embodiment will be explained using FIGS. 1 to 4. FIG. 1 is a side view of the electrostatic coating device of the first embodiment of the present invention. FIG. 2 is a view showing surface-butting parts of a coupling part of the first embodiment. FIG. 3 is a view illustrating the overall configuration of a substitution part of the first embodiment. FIG. 4 is a view illustrating a blowing port, exhaust port and substituted space constituting the substitution part of the first embodiment.

First, an outline of the electrostatic coating device 1 will be explained.

The electrostatic coating device 1 has a body part 10, a head part 20, and a coupling part 60 that couples the body part 10 and head part 20. The electrostatic coating device 1 is a device for electrostatically coating the body, etc. of automobiles, for example.

The body part 10 is a column-shaped member mounted to the leading end of a robot arm 3.

The head part 20 is a member having a rotary atomizing head 21 that sprays coating material to which high voltage has been applied.

The coupling part 60 is a portion coupling the body part 10 and head part 20. The coupling part 60 has a surface-butting part 62 at which a first end face 64 that is an end face of the body part 10, and a second end face 66 that is an end face of the head part 20 are surface butting.

The electrostatic coating device 1 has a plurality of paths 300*a*-300*l* arranged over the body part 10 and head part 20. Each of the plurality of paths 300*a*-300*l* is configured to have a tube and/or coupler. Each of the plurality of paths 300*a*-300*l* is connected to a light source, compressed-air supply source, and coating material supply source, which are not illustrated, whereby optical signals, air, coating material and cleaning liquid are sent.

In the present embodiment, the electrostatic coating device 1 has coating material paths 300*b* and 300*k* (first paths) in which coating material (first fluid) is sent, as well as high voltage being applied thereto. In addition, the electrostatic coating device 1 has washing fluid paths 300*c*, 300*i* (second paths) which are connected to earth and in which washing fluid (second fluid) is sent. In the present embodiment, the coating material path 300*b* and washing fluid path 300*c* are arranged adjacently.

Each of the plurality of paths 300*a*-300*l* has a plurality of body-side paths 310*a*-310*l*, and a plurality of head-side paths 320*a*-320*l*. The plurality of body-side paths 310*a*-310*l*, and the plurality of head-side paths 320*a*-320*l* are connected by connecting parts 450*a*-450*l* at the surface-butting part 62.

The electrostatic coating device 1 of the present embodiment has a substitution part 200 that substitutes air stagnating between each of the connecting parts 450*a*-450*l* in the surface-butting part 62 with new air.

Next, the configuration of the electrostatic coating device 1 will be explained in detail.

As shown in FIG. 1, the body part 10 has a body main body 11, cover part 12, base part 30 and cascade housing part 40.

The body main body 11 is arranged at the interior of the body part 10. A plurality of tubes constituting various paths is connected to the body main body 11.

The cover part 12 covers the outer circumferential face of a central portion of the body main body 11. The cover part 12 is a cylindrical shape, and can be divided in two along the body main body 11. The cover body 12 is sandwiched by a leading edge thereof being inserted between the inner circumferential face of a coupling ring 50 and the outer circumferential face of a leading-end flanged part 43 of the body main body 11.

The base part 30 is arranged at a base-end side of the body main body 11. A plurality of tubes constituting various paths and a low-voltage cable connected to the cascade 41 are arranged to be inserted into the base part 30.

The cascade housing part 40 is arranged to be installed in the base part 30. The cascade housing part 40 has a through hole (not illustrated) from an end face to the leading end face. The cascade housing part 40 houses a cascade 41 in the through hole.

The cascade 41 is housed in the through hole. The cascade 41 is housed in the through hole so that a gap forms between a majority of the outer circumferential face of this cascade 41 and the inner wall face of the through hole. As mentioned above, the low-voltage cable (not illustrated) penetrating the base part 30 and extending is connected to the cascade 41.

In addition, as shown in FIG. 2, the leading end side of the cascade 41 is arranged to project from substantially the center of the leading end face of the leading-end flanged part 43 along the axial direction.

As shown in FIG. 2, the brim-shaped leading-end flanged part 43 is formed at a leading end side of the cascade housing part 40. In the present embodiment, the leading end face of the leading-end flanged part 43 constitutes a first end face 64 of the body part 10.

As shown in FIGS. 2 and 3, the body-side couplers 433*a*-433*l* are aligned in a ring shape at the first end face 64, which is the leading end face of the leading-end flange part 43. The body-side couplers 433*a*-433*l* are provided to be exposed on one side at the first end face 64, which is the leading end face of the leading-end flanged part 43.

Herein, the body-side couplers 433*a*-433*l* constitute connecting parts 450*a*-450*l* along with O-ring parts 435*a*-435*l* described later.

In addition, a positioning pin 436 is provided to project at an outer circumferential side of the leading end face of the leading-end flanged part 43.

As shown in FIGS. 1 and 2, the head part 20 is a member having a rotary atomizing head 21 that sprays coating material to which high voltage has been applied. The head part 20 is a substantially chevron shape having a leading end portion bent, and has an air motor that is not illustrated, the rotary atomizing head 21 that is rotationally driven by this air motor, and an air cap 22 that encloses the rotary atomizing head 21.

The air motor causes the rotary atomizing head 21 to rotate at high speed by way of air being supplied thereto. Optical fiber through which the optical signals are transmitted is connected to the air motor, and the revolution speed of the air motor is outputted as an optical signal through this optical fiber.

A passage through which air flows is connected to the air cap 22, and the flowrate of air ejecting from the air cap 22 varies to adjust the coating area by causing the air flowrate supplied to this air cap 22 to change.

A cascade insertion part 24 to which the leading end side of the cascade 41 is inserted and a positioning pin insertion hole 203 into which the positioning pin 436 is inserted are formed in the second end face 66, which is the base-end face of the head part 20. A connection terminal 25 of an electric power line is provided at the bottom face of the cascade insertion part 24, and this connection terminal 25 is electrically connected to the rotary atomizing head 21. Electric power outputted from the cascade is transmitted to the rotary atomizing head 21 by way of this electric power line.

A threaded part 23 is formed in the outer circumferential face of the base-end side of the head part 20. A threaded part of the coupling ring 50 threads together with the threaded part 23 of the head part 20.

The plurality of O-ring parts 435*a*-435*l* are arranged at the second end face 66, which is the base-end face of the head part 20. The plurality of O-ring parts 435*a*-435*l* are arranged at positions corresponding to the couplers 433*a*-433*l* arranged at the first end face 64 of the body part 10.

The plurality of O-ring parts 435*a*-435*l* are arranged to be exposed on one side at the second end face 66 of the head part 20.

The O-ring parts 435*a*-435*l* constitute connecting parts 450*a*-450*l* along with the couplers 433*a*-433*l*.

The coupling part 60 is a portion coupling the body part 10 and head part 20. The coupling part 60 has the coupling ring 50 and surface-butting part 62.

The coupling ring 50 couples the body part 10 and head part 20 so that the head part 20 is rotatable relative to the body part 10.

The coupling ring 50 is a cylindrical member. A threaded part that threads with the threaded part 23 formed in the head part 20 is formed in the inner circumferential face on the leading end side of the coupling ring 50.

In addition, by a protrusion (not illustrated) of the coupling ring 50 engaging with a protrusion (not illustrated) of the leading-end flanged part 43, movement of the coupling ring 50 to the leading end side is restricted, as well as being retained to freely rotate.

The surface-butting part 62 is a portion at which the first end face 64, which is the end face of the body part 10, and the second end face 66, which is the end face of the head part 20, are surface butting with each other. The surface-butting part 62 is a portion formed by the first end face 64 and second end face 66 closely contacting each other.

The aforementioned connecting parts 450*a*-450*l* are arranged at the surface-butting part 62. Each of the connecting parts 450*a*-450*l* is configured, as mentioned above, by the couplers 433*a*-433*l* formed at the first end face 64, and the O-ring parts 435*a*-435*l* formed at the second end face 66.

In addition, as shown in FIGS. 2 to 4, the blowing port 230, exhaust port 240 and substituted space part 234 constituting the substitution part 200 are arranged at the surface-butting part 62.

Next, as mentioned above, the electrostatic coating device 1 has a plurality of paths 300*a*-300*l* arranged over the body part 10 and head part 20. Each of the plurality of paths 300*a*-300*l* is configured to have a tube and coupler.

More specifically, the plurality of paths 300*a*-300*l* has the body-side paths 310*a*-310*l* arranged on the body part 10 side, the head-side paths 320*a*-320*l* arranged on the head part 20 side, and the connecting parts 450*a*-450*l* arranged at the coupling part 60. The plurality of body-side paths 310*a*-310*l* and the plurality of head-side paths 320*a*-320*l* are connected by the connecting parts 450*a*-450*l* at the surface-butting part 62.

Each of the plurality of paths 300*a*-300*l* is connected to the light source, compressed air supply source and coating material supply source, which are not illustrated, whereby optical signals, air, coating material and washing fluid are sent.

In addition, as mentioned above, the electrostatic coating device 1 has the coating material paths 300*b* and 300*k* (first paths) to which high voltage is applied along with coating material (first fluid) being sent therethrough. In addition, the electrostatic coating device 1 has the washing fluid paths 300*c* and 300*i* (second paths) that are connected to ground and in which the washing fluid (second fluid) is sent.

The coating material paths 300*b* and 300*k* (first paths) to which high voltage is applied have body-side coating material paths 310*b* and 310*k* arranged at the side of the body part 10, head-side coating material paths 320*b* and 320*k* arranged at the side of the head part 20, and connecting parts 450*b* and 450*k* arranged at the coupling part 60.

In addition, the washing fluid paths 300*c* and 300*i* (second paths) that are connected to earth have the body-side washing fluid paths 310*c* and 310*i* arranged at the body part 10 side, the head-side washing fluid paths 320*c* and 320*i* arranged at the head part 20 side, and the connecting parts 450*c* and 450*i* arranged at the coupling part 60. The body-side washing fluid paths 310*c* and 310*i* and the head-side washing fluid paths 320*c* and 320*i* are connected by the connecting parts 450*c* and 450*i* at the surface-butting part 62.

In addition, in the present embodiment, the coating material path 300*b* and washing fluid path 300*c* are arranged adjacently. In the surface-butting part 62, the connecting part 450*b* and connecting part 450*c* are arranged adjacently.

Next, the substitution part 200 substitutes the entirety or part of the air stagnating between each of the connecting parts 450*a*-450*l* at the surface-butting part 62 with new air. The substitution part 200, for example, substitutes the entirety or part of the air stagnating between the connecting part 450*b* and connecting part 450*c*, which are arranged adjacently to each other, with new air.

As shown in FIGS. 2 to 4, the substitution part 200 has an air supply part 210, air supply path 220, blowing port 230, substituted space 235, exhaust port 240, and air discharge path 250.

The air supply part 210 has an air supply source and air supply controller (not illustrated). The air supply part 210 starts/ends air supply at predetermined timings. In the present embodiment, the air supply part 210, for example, performs air supply with the electrostatic coating device 1 in a coating operation state (e.g., state spraying coating material).

The air supply path 220 is connected to the air supply part 210. The air supply path 220 is configured to be able to supply air from the air supply part 210 to the blowing port 230.

The blowing port 230 is formed in the surface-butting part 62 of the coupling part 60. More specifically, the blowing port 230 is formed in the second end face 66 of the head part 20 in the present embodiment.

At the blowing port 230, air supplied from the air supply part 210 is blown into the surface-butting part 62 via the air supply path 220. More specifically, the blowing port 230 blows the air supplied from the air supply part 210 into the substituted space 235 via the air supply path 220. In the present embodiment, the blowing port 230 is arranged at an opposite side to the exhaust port 240 interposing the cascade 41.

The substituted space 235 is formed in the surface-butting part 62. The substituted space 235 is formed at the first end face 64 of the body part 10 in the present embodiment. The substituted space 235 is formed so as to link the blowing port 230 and exhaust port 240. The substituted space 235 is configured so that stagnating air inside thereof is discharged from the exhaust port 240 by air blown in from the blowing port 230.

The substituted space 235 is formed between the connecting parts 450*a*-450*l*. The substituted space 235 is a space formed in order to replace air stagnating between the connecting parts 450*a*-450*l* with new air.

In the present embodiment, the substituted space 235 is formed in order to replace the air between connecting part 450*b* constituting the coating material path 300*b* and the connecting part 450*c* constituting the washing fluid path 300*c* with new air.

For this reason, the substituted space 235 is formed so at least a part thereof is arranged between the connecting part 450*b* and the connecting part 450*c*. For example, the substituted space 235 is configured to have a portion intersecting a straight line linking the connecting part 450*b* and connecting part 450*c*.

In addition, the substituted space 245 preferably is formed so as to surround the connecting part 450*b* or connecting part 450*c*.

In the present embodiment, the substituted space 235 is formed in a ring shape having a predetermined width at the outer circumferential side of the first end face 64. The substituted space 235 of the present embodiment is formed so that at least a part thereof is formed to be arranged between the connecting part 450*b* and connecting part 450*c*, and surrounds the connecting part 450*b* or connecting part 450*c*. Furthermore, the substituted space 235 is configured to enable replacing the air stagnating between the connecting parts 450*a* to 450*l* with new air.

In addition, as mentioned above, in the state of the electrostatic coating device 1 in coating operation (for example, state spraying coating material), the air supply is performed by the air supply part 210, whereby the air stagnating in the substituted space 235 is always replaced with new air in the coating operation state. In other words, the air stagnating between the connecting part 450*b* and connecting part 450*c* is always replaced with new air in the coating operation state.

The exhaust port 240 is formed in the surface-butting part 62 of the coupling part 60. More specifically, the exhaust port 240 is formed at the first end face 64 of the body part 10 in the present embodiment. In the present embodiment, the exhaust port 240 is arranged at the opposite side to the blowing port 230 to interpose the cascade 41.

The exhaust port 240 is a portion at which the air stagnating at the surface-butting part 62 is discharged. The exhaust port 240 is a portion at which the air stagnating in the substituted space 235 is discharged.

The air discharge path 250 is connected to the exhaust port 240. The air discharge path 250 is configured to enable discharging air from the exhaust port 240 to an external space, for example.

Figure 5:
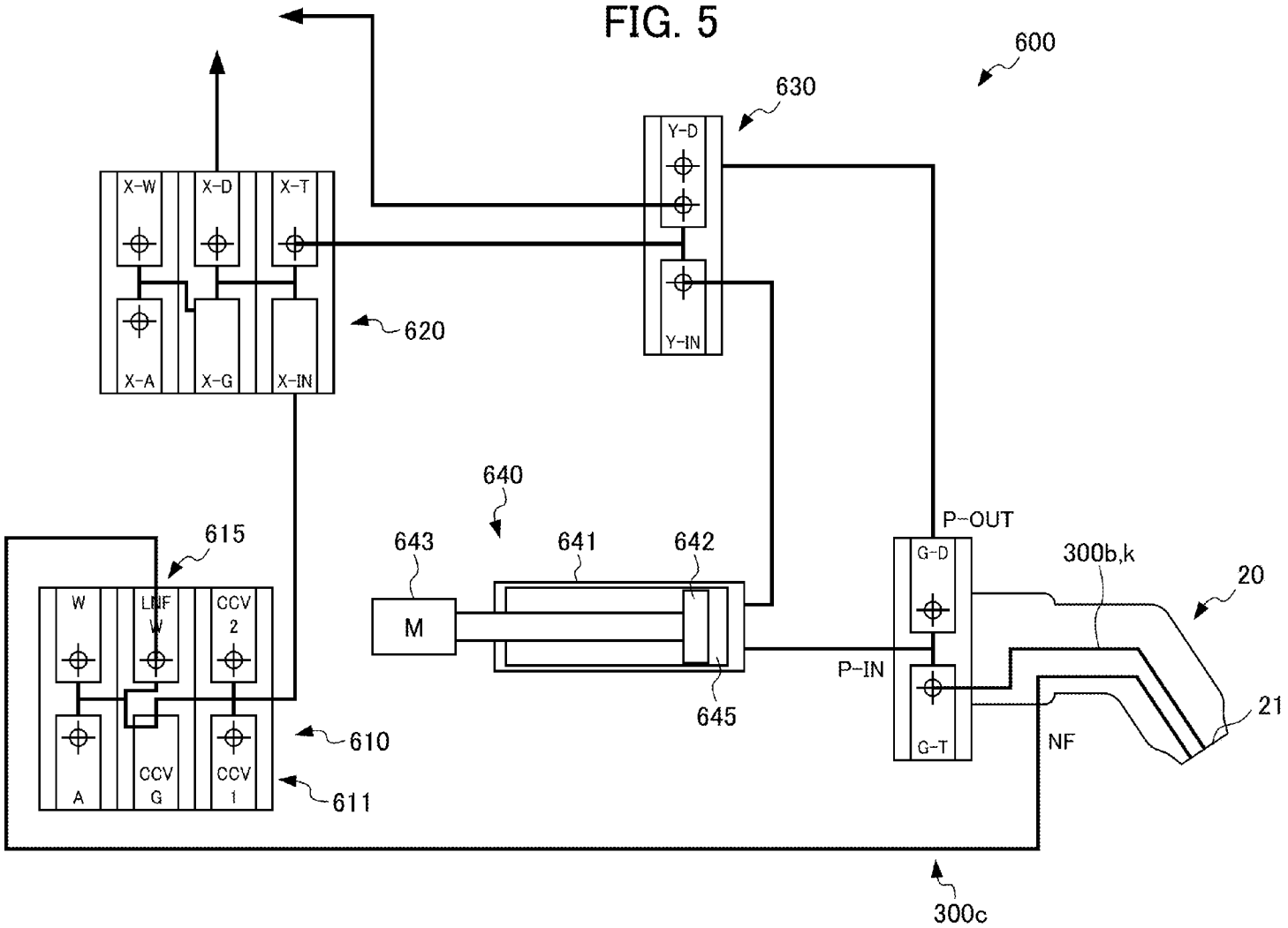
FIG. 5 is a view illustrating an electrostatic coating system of the electrostatic coating device of the first embodiment.

Next, an electrostatic coating system of the electrostatic coating device 1 will be explained using FIG. 5. FIG. 5 is a view illustrating an electrostatic coating system of the electrostatic coating device 1 of the first embodiment.

As shown in FIG. 5, the electrostatic coating device 1 has an electrostatic coating system 600.

The electrostatic coating system 600 includes a color-change valve mechanism 610 having a cleaning valve 615, an X-valve mechanism 620, a Y-valve mechanism 630, and an intermediate storage device 640.

The color-change valve mechanism 610 has a plurality of coating material valves 611 correspond to a plurality of types of coating materials, and the cleaning valve 615. The color-change valve mechanism 610 is grounded.

The plurality of coating material valves 611 are connected to a plurality of coating material tanks (not illustrated), and control the supply of conductive coating materials of different paint colors.

The cleaning valve 615 is connected to a washing fluid tank (not illustrated) and air supply source, and controls the supply of washing fluid W and drying air A. The cleaning valve 615 supplies washing fluid W to the leading end of the head part 20 via the washing fluid path 300*c*, along with supplying drying air A.

The X-valve mechanism 620 is configured to enable supplying coating material to the Y-valve mechanism 630. In addition, the X-valve mechanism 620 is configured to enable supplying washing fluid W and drying air A to the path to the Y-valve mechanism 630. The X-valve mechanism 620 enters an isolated state from the Y-valve mechanism 630, in a state of the electrostatic coating system 600 (electrostatic coating device 1) in coating operation.

The Y-valve mechanism 630 is configured to enable supplying coating material supplied from the X-valve mechanism 620 to the intermediate storage device 640. In addition, the Y-valve mechanism 630 enters an isolated state from the X-valve mechanism 620 with the electrostatic coating system 600 (electrostatic coating device 1) in a coating operation state.

The intermediate storage device 640 has a cylinder 641, piston 642, and servo motor 643.

The cylinder 641 is a substantially cylindrical shape, and is made of insulating resin. The cylinder chamber 645 in which the conductive coating material is stored is formed inside the cylinder 651 via the piston 642.

The piston 642 is made of insulating resin. The piston 642 makes a sliding motion in the cylinder chamber 645 by way of the driving of the servo motor 643. By the piston 642 making a sliding motion in the cylinder chamber 645, the conductive coating material stored in the cylinder chamber 645 is supplied to the rotary atomizing head 21. The rotary atomizing head 21 sprays coating material to which high voltage has been applied by way of a high-voltage application unit (not illustrated).

Herein, the washing fluid W supplied from the cleaning valve 615 of the color-change valve mechanism 610 may remain in the washing fluid path 300*c*. In the washing fluid path 300*c*, although drying air A is supplied for drying the path along with pushing out the washing fluid W, washing fluid W may remain by the influences such as compression at the time of color change.

Then, the electrostatic coating system 600 (electrostatic coating device 1) applies high voltage to the coating material, which may ground leak from the coating material path 300*b* to the washing fluid path 300*c*, for example, in the coating operation state of spraying.

In the case of the location of ground leakage being the surface-butting part 62, oxygen and nitrogen in the air stagnating between paths may convert to ozone and nitrogen oxides. In this case, the first end face 64 and second end face 66 may corrode from the ozone and nitrogen oxides.

Herein, in the present embodiment, since the substitution part 200 substitutes the air stagnating between paths at the surface-butting part 62 with new air, it is possible to suppress the adverse effects occurring from the aforementioned ground leakage.

Figure 6:
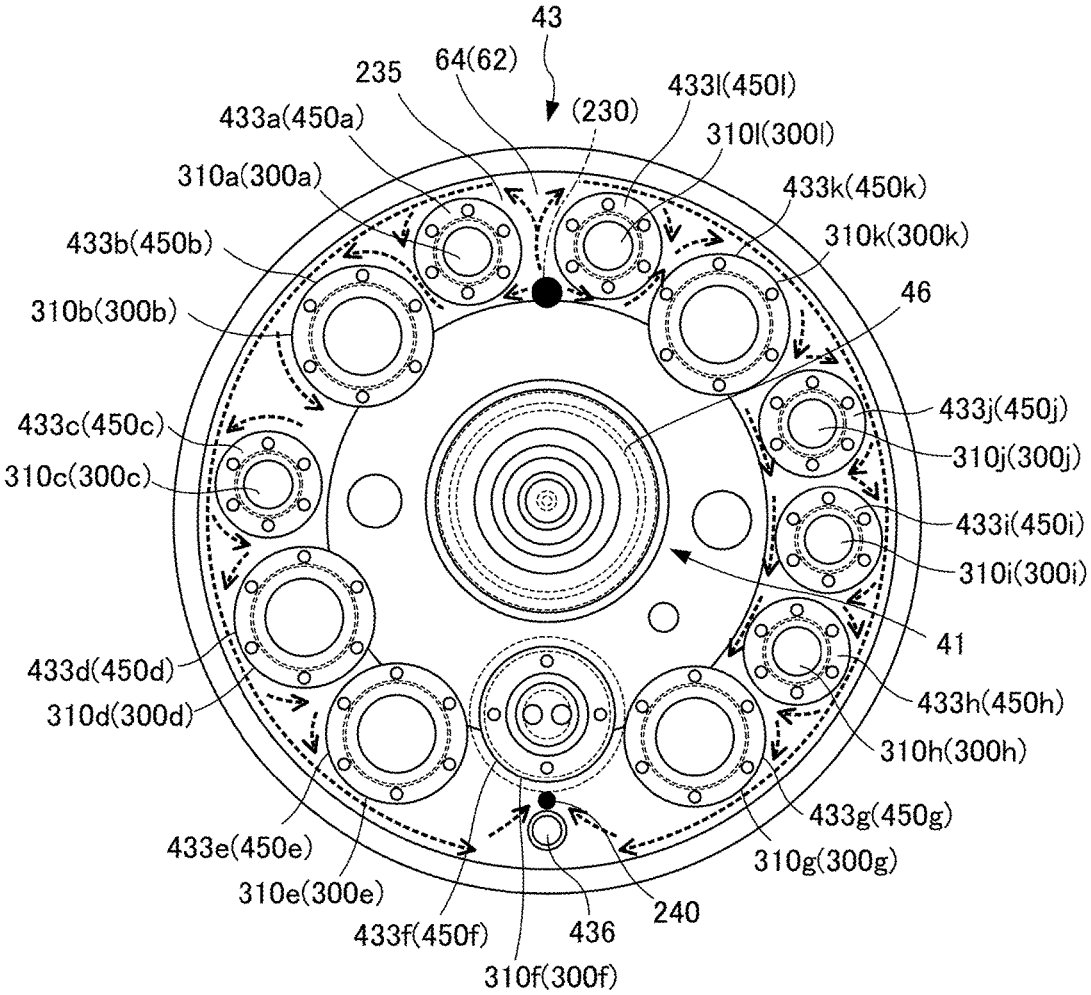
FIG. 6 is a view illustrating operation of the substitution part of the first embodiment.

Next, operation of the substitution part 200 of the electrostatic coating device 1 will be explained. FIG. 6 is a view illustrating operation of the substitution part of the first embodiment.

The substitution part 200 performs the supply of air by way of the air supply part 210 while the electrostatic coating device 1 is in the coating operation state. The air supplied by the air supply part 210 is supplied to the blowing port 230 formed in the surface-butting part 62 (second end face 66) via the air supply path 220.

The substitution part 200 substitutes the air stagnating in the substituted space 235 with new air by supplying air from the blowing port 230 to the substituted space 235.

More specifically, as shown in FIG. 6, the air supplied from the blowing port 230 to the substituted space 235 is flowed so as to head towards the exhaust port 240. In detail, the air is flowed from the blowing port 230 towards the exhaust port 240 between each of the paths as shown schematically by the arrows. The air is thereby continuously replaced between each of the paths 300*a*-300*l*.

The substitution part 200 substitutes the air stagnating between the paths 300*a*-300*l* at the surface-butting part 62 with new air continuously. The substitution part 200 substitutes the air stagnating between the coating material path 300*b* and washing fluid path 300*c* at the surface-butting part 62 with new air continuously.

Then, the substitution part 200 causes the air stagnating in the substituted space 235 to discharge to outside via the air discharge path 250 by the exhaust port 240.

Figure 7:
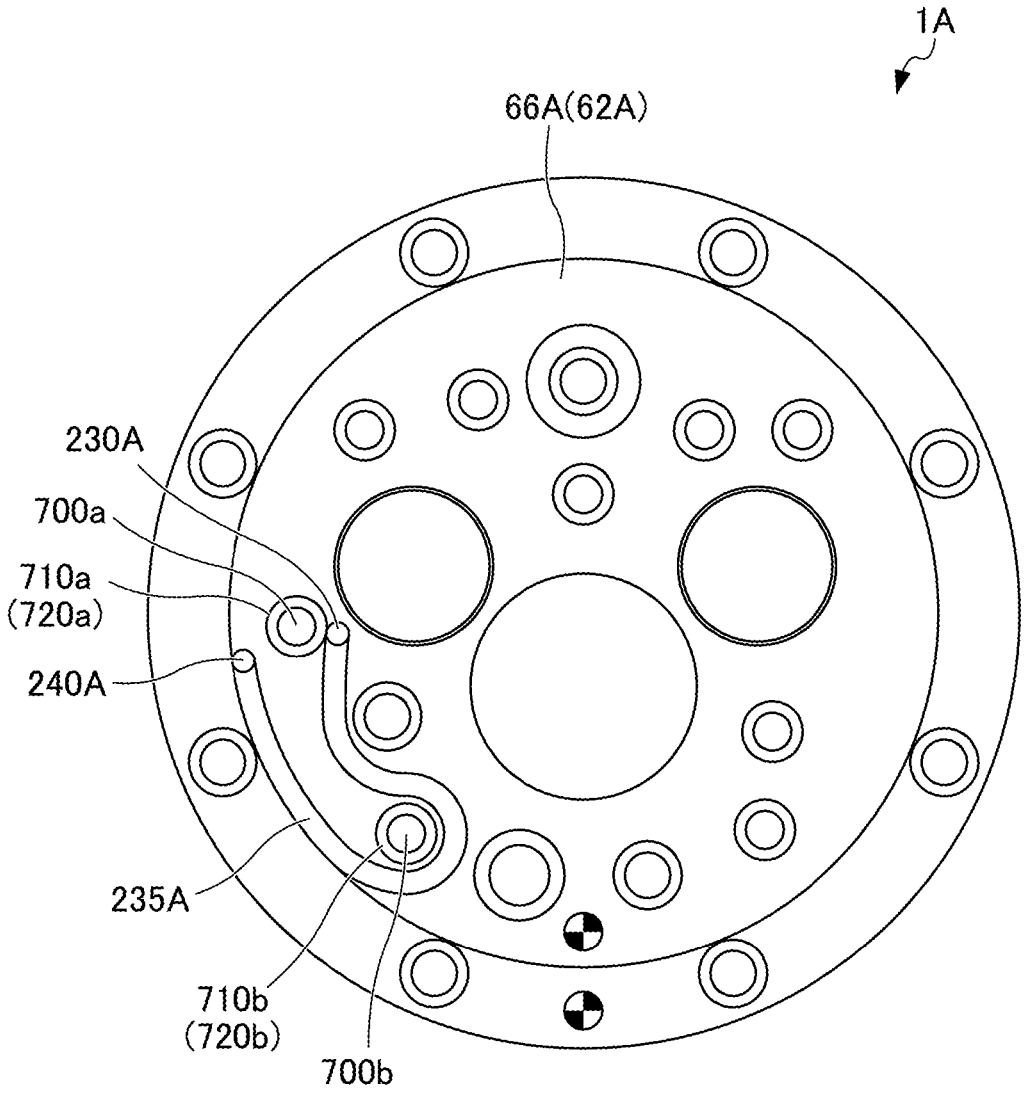
FIG. 7 is a view illustrating a blowing port, exhaust port and substituted space constituting the substitution part of a second embodiment.
Figure 8:
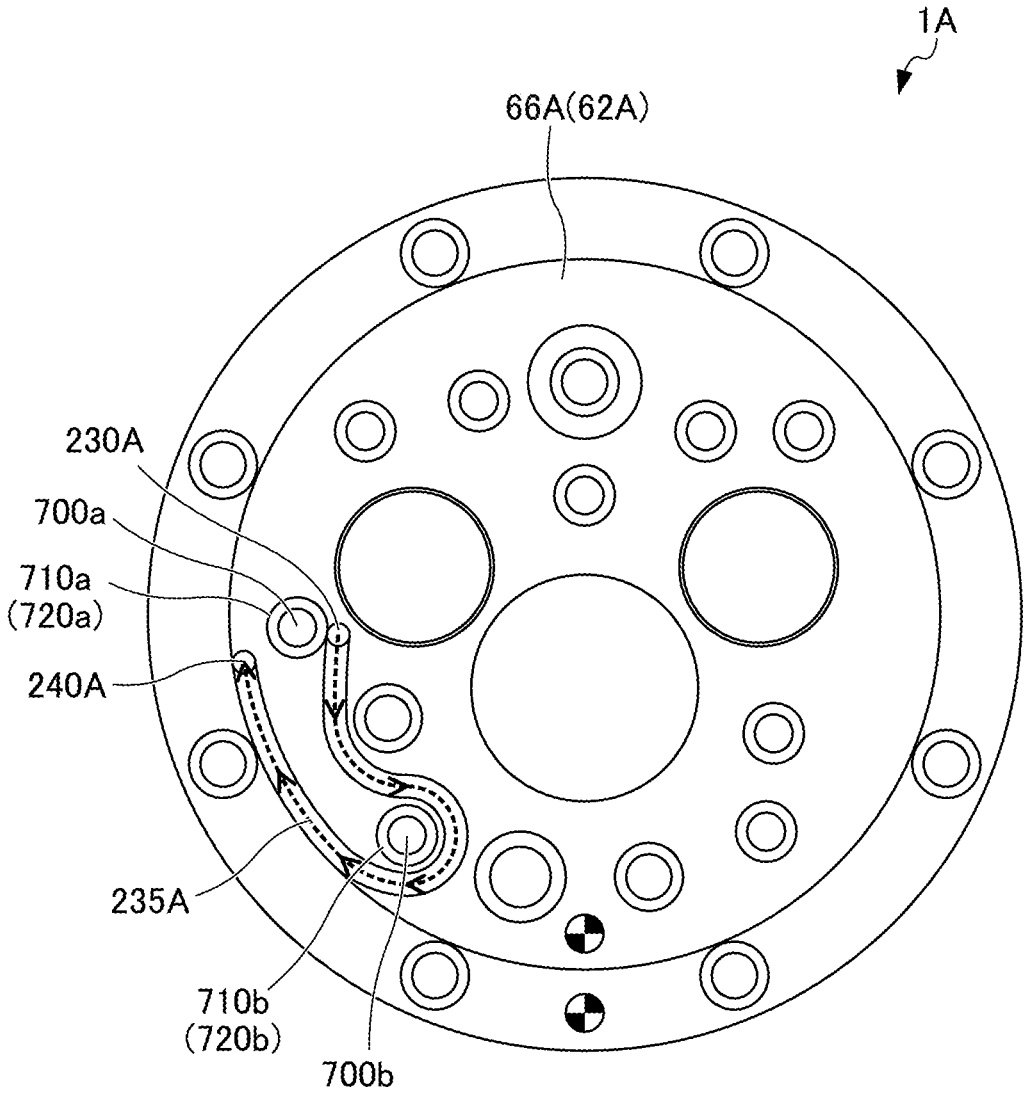
FIG. 8 is a view illustrating operations of a substitution part of the second embodiment.

Next, an electrostatic coating device 1A of a second embodiment of the present invention will be explained using FIGS. 7 and 8. FIG. 7 is a view illustrating a blowing port, exhaust port and substituted space constituting the substitution part of a second embodiment. FIG. 8 is a view illustrating operation of the substitution part of the second embodiment. It should be noted that an explanation is provided focusing on the portions differing from the first embodiment, and explanations are abbreviated for portions that are the same as the first embodiment.

As shown in FIG. 7, the coating material path 700*a* and washing fluid path 700*b* of the present embodiment are arranged adjacently to each other at the surface-butting part 62A. In the surface-butting part 62A, the connecting part 720*a* and connecting part 720*b* are arranged adjacently to each other.

In the present embodiment, the blowing port 230A, exhaust port 240A and substituted space 235A constituting the substitution part 200A are formed at the second end face 66A.

In the present embodiment, the substituted space 235A is formed so as to link the blowing port 230A and exhaust port 240A. The substituted space 235A is formed so as to surround the connecting part 720*b*. In addition, the substituted space 235A is formed so that at least a part thereof is arranged between the connecting part 720*a* and connecting part 720*b*.

In the present embodiment, as shown in FIG. 8, the air supplied to the substituted space 235A is flowed so as to head from the blowing port 230A towards the exhaust port 240A, as shown by the arrows.

In the present embodiment, the substituted space 235A is formed so as to surround the connecting part 720*b*, and is formed so that at least a part thereof is arranged between the connecting part 720*a* and connecting part 720*b*. In the present embodiment, the air stagnating between the coating material path 700*a* (connecting part 720*a*) and washing fluid path 700*b* (connecting part 720*b*) is replaced by new air. In the present embodiment, the substituted space 235A is formed so that the substitution effect improves in a small region.

Figure 9:
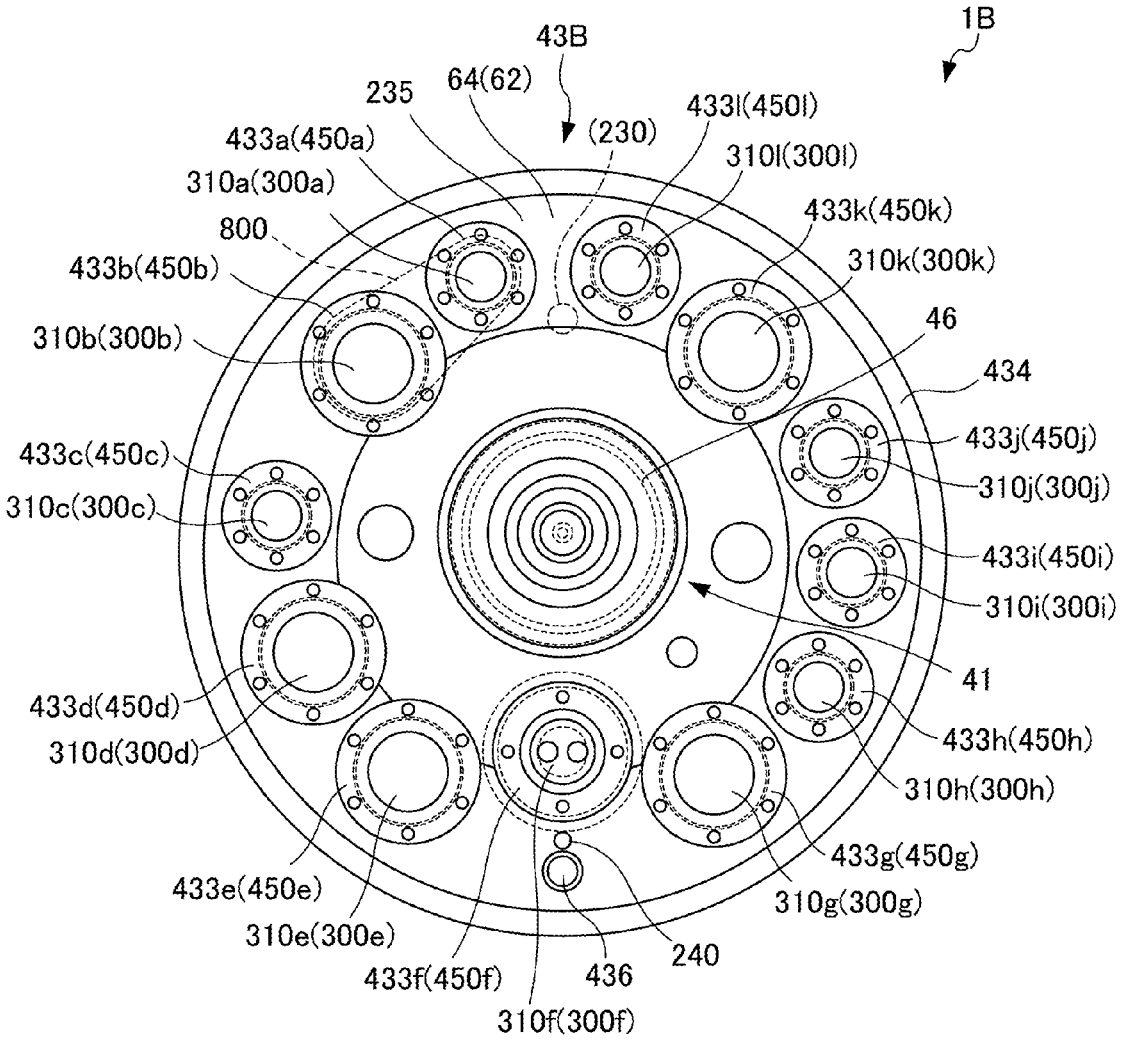
FIG. 9 is a view illustrating an electrostatic coating device of a third embodiment of the present invention.

Next, an electrostatic coating device 1B of a third embodiment of the present invention will be explained using FIG. 9. FIG. 9 is a view illustrating the electrostatic coating device of the third embodiment of the present invention. It should be noted that an explanation is provided focusing on the portions differing from the first embodiment, and explanations are abbreviated for portions that are the same as the first embodiment.

In the present embodiment, as shown in FIG. 9, the electrostatic coating device 1B has a conductive part 800 having at least a part thereof arranged inside of the body part 10, and that electrically links the coating material path 300*b* and washing fluid path 300*c*.

In the present embodiment, the conductive part 800 is arranged so as not to be exposed at the first end face 64B.

The conductive part 800 suppresses ground leakage from occurring at the surface-butting part 62B (first end face 64B, second end face 66B) by electrically linking the coating material path 300*b* and washing fluid path 300*c* inside of the body part 10.

The following such effects are exerted according to the aforementioned first to third embodiments.

The electrostatic coating device 1 includes the substitution part 200 that substitutes the entirety or part of the air stagnating between the coating material path 300*b* and washing fluid path 300*c* with new air. Since it is thereby possible to replace with new air and discharge ozone and nitrogen oxides generated due to ground leakage occurring between paths, corrosion can be suppressed from occurring at the insulating member, etc. at the periphery of the coating material supply/discharge paths.

In addition, the substitution part 200 substitutes the entirety or part of the air stagnating between the connecting part 450*b* and connecting part 450*c* at the surface-butting part 62 with new air. Since it is thereby possible to replace with new air and discharge ozone and nitrogen oxides generated due to ground leakage occurring at the surface-butting part, corrosion at the insulating member, etc. at the periphery of the coating material supply/discharge paths can be suppressed from occurring.

In addition, the substitution part 200 includes the blowing port 230 formed in the first end face 64 or second end face 66, and blowing in air to the surface-butting part 62, and the exhaust port 240 formed in the first end face 64 or second end face 66, and through which air stagnating at the surface-butting part 62 is discharged. Since it is thereby possible to more reliably replace with new air and discharge ozone and nitrogen oxides generated due to ground leakage occurring at the surface-butting part, corrosion at the insulating member, etc. at the periphery of the coating material supply/discharge paths can be more reliably suppressed from occurring.

In addition, the substitution part 200 has the substituted space 235 that is formed in least one among the first end face 64 and second end face 66 so as to link the blowing port 230 and exhaust port 240, and is configured so that the air stagnated inside is discharged from the exhaust port 240 by air blown in from the blowing port 230. Since it is thereby possible to more reliably replace with new air and discharge ozone and nitrogen oxides generated due to ground leakage occurring at the surface-butting part, corrosion at the insulating member, etc. at the periphery of the coating material supply/discharge paths can be more reliably suppressed from occurring.

In addition, the substituted space 235 is formed so that at least a part thereof is arranged between the connecting part 450*b* and the connecting part 450*c*. Since it is thereby possible to more reliably replace with new air and discharge this ozone and nitrogen oxides at the locations at which corrosion, etc. occurring due to the oxygen and nitrogen at the surface-butting part converting to ozone and nitrogen oxides tends to occur, corrosion at the insulating member, etc. at the periphery of the coating material supply/discharge paths can be more reliably suppressed from occurring.

In addition, the substituted space 235 is formed so as to surround the connecting part 450*b* or connecting part 450*c*. Since it is thereby possible to more reliably replace with new air and discharge this ozone and nitrogen oxides at the locations at which corrosion, etc. occurring due to the oxygen and nitrogen at the surface-butting part converting to ozone and nitrogen oxides tends to occur, corrosion at the insulating member, etc. at the periphery of the coating material supply/discharge paths can be more reliably suppressed from occurring.

In addition, the electrostatic coating device has a conductive part 800 for which at least a part is arranged inside of the body part 10, and electrically links the coating material path 300*b* and washing fluid path 300*c*. Since it is thereby possible to decrease the ground leakage itself at the surface-butting part, corrosion can be suppressed from occurring at the insulating member, etc. at the periphery of the coating material supply/discharge paths due to ground leakage occurring between paths at the surface-butting part, etc.

The present invention is not to be limited to the aforementioned embodiments, and modifications, improvements, etc. within a scope that can achieve the object of the present invention are also to be encompassed by the present invention.

For example, although the blowing port, exhaust port and substituted space constituting the substitution part are formed at either of the first end face or second end face in the aforementioned embodiments, they are not to be limited to the stipulations of the aforementioned embodiments, and may be formed in both the first end face and second end face.

In addition, although the substituted space is formed so as to surround the second connecting part in the aforementioned embodiments, it is not to be limited thereto, and may be formed so as to surround the first connecting part.

In addition, embodiments which are arrived at by combining the aforementioned first to third embodiments as appropriate are also encompassed by the present invention.

EXPLANATION OF REFERENCE NUMERALS

1 electrostatic coating device
10 body part
20 head part
60 coupling part
62 surface-butting part
64 first end face
66 second end face
200 substitution part
210 air supply part
220 air supply path
230 blowing port
235 substituted space
240 exhaust port
250 air discharge path
300*b* coating material path (first path)
300*c* washing fluid path (second path)
310*b* body-side coating material path (body-side first path)
310*c* body-side washing fluid path (body-side second path)
320*b* head-side coating material path (head-side first path)
320*c* head-side washing fluid path (head-side second path)
450*b* connecting part (first connecting part)
450*c* connecting part (second connecting part)
600 electrostatic coating system
800 conductive part

The invention claimed is:

1. An electrostatic coating device comprising:

a body part configured to be mountable to a leading end of a robot arm;

a head part separate from the body part, the head part having a rotary atomizing head that sprays coating material to which high voltage has been applied from a cascade which is configured to output an electric power and have a columnar body that is coaxially disposed along an axis of the body part;

a coupler configured to couple the body part and the head part;

a first path disposed to span the body part and the head part, through which a first fluid is fed, and to which high voltage is applied;

a second path disposed to span the body part and the head part, through which a second fluid is fed, and is grounded to earth, wherein the first path includes:

a body-side first path disposed at a side of the body part;

a head-side first path disposed at a side of the head part; and a first connector disposed at the coupler, and configured to connect the body-side first path and the head-side first path;

wherein the second path includes:

a body-side second path disposed at a side of the body part;

a head-side second path disposed at a side of the head part; and a second connector disposed at the coupler, and configured to connect the body-side second path and the head-side second path;

wherein the coupler has a surface-butting part configured by a first end face that is an end face of the body part and a second end face that is an end face of the head part abutting each other; and a substitution part configured by the first end face and the second end face in-between while spreading spatially along the surface-butting part except the first connector and the second connector so as to form a substituted space having gas replaced inside thereof;

wherein the substitution part includes:

an air supply part including an air supply source and air supply controller;

an air supply path configured to be connected the air supply part;

a blowing port that is formed in the first end face or the second end face, while the blowing port is connected to an air supply path thereby blowing air into the surface-butting part, and an exhaust port that is formed in the other of the first end face or the second end face, and through which air stagnating at the surface-butting part is discharged, wherein the blowing port is arranged at an opposite side to the exhaust port interposing the cascade.

* * * * *